US007788857B2

(12) United States Patent
Spengler et al.

(10) Patent No.: US 7,788,857 B2
(45) Date of Patent: Sep. 7, 2010

(54) CLOSURE RAIL FOR ROOFING AND METHOD USING SAME

(76) Inventors: Jeffrey Spengler, 2157 W. Forest Ave., Decatur, IL (US) 62522; Jacob Spengler, 2157 W. Forest Ave., Decatur, IL (US) 62522

( * ) Notice: Subject to any disclaimer, the term of this patent is extended or adjusted under 35 U.S.C. 154(b) by 0 days.

(21) Appl. No.: 11/958,084

(22) Filed: Dec. 17, 2007

(65) Prior Publication Data

US 2009/0151270 A1 Jun. 18, 2009

(51) Int. Cl.
*E04D 3/36* (2006.01)
*E04D 1/30* (2006.01)
*E04D 1/34* (2006.01)
*E04D 1/36* (2006.01)

(52) U.S. Cl. ..... 52/94; 52/58; 52/57; 52/556

(58) Field of Classification Search ..... 52/58, 52/94, 95, 198, 199, 219, 57, 551, 96, 716.8, 52/800.11, 800.12, 800.18, 748.1, 71, 712, 52/519, 547, 556; 454/365
See application file for complete search history.

(56) References Cited

U.S. PATENT DOCUMENTS 1,882,177 A * 10/1932 Burris ..... 52/549
2,755,484 A * 7/1956 Hotz ..... 52/509
3,024,573 A * 3/1962 McKinley ..... 52/96
4,024,685 A 5/1977 Aarons
4,047,353 A 9/1977 Aarons
4,114,340 A * 9/1978 Dean et al. ..... 52/520
4,184,299 A * 1/1980 East ..... 52/463
4,361,998 A * 12/1982 Ellison et al. ..... 52/520
4,435,926 A * 3/1984 Struben ..... 52/3
4,641,475 A * 2/1987 Berridge ..... 52/584.1
4,685,265 A * 8/1987 Cooper ..... 52/277
5,193,321 A * 3/1993 Edwards ..... 52/466
5,222,341 A * 6/1993 Watkins et al. ..... 52/547
5,363,624 A * 11/1994 Cotter ..... 52/547

(Continued)

OTHER PUBLICATIONS

Jim Flasch, Standing-Seam Metal Roofs, copyright BobVila.com 2006, http://www.bobvila.com/HowTo_Library/StandingSeam_Metal_Roofs-Metal_Roofing-A1984.html, pp. 1-2, Sep. 5, 2007.

(Continued)

*Primary Examiner*—Brian E Glessner
*Assistant Examiner*—Jason Holloway
(74) *Attorney, Agent, or Firm*—Beem Patent Law Firm

(57) ABSTRACT

A closure rail may be secured along a ridge, hip, or eave of a roof to receive and secure panels in a roofing system. A closure rail may be made from a sheet of metal, folded or creased to create a cover, expanse, extension, flange, and hinge. The hinge may connect adjoining sides of the cover and expanse to allow the cover to close down on and secure an end of a panel. The extension may elevate the flange above the height of a rib on the panel to facilitate attachment of a ridge or hip cap or flashing. Multiple covers, separated by notches, may attach to an expanse, thereby allowing one closure rail to secure multiple panels. A closure rail may be used instead of "Z" closures. Such a method may allow for securing the closure rail to the roof before the panels.

20 Claims, 2 Drawing Sheets

U.S. PATENT DOCUMENTS

| | | | | |
|---|---|---|---|---|
| 5,537,791 | A * | 7/1996 | Champagne | 52/520 |
| 5,605,022 | A * | 2/1997 | Fulton | 52/199 |
| 5,634,314 | A * | 6/1997 | Champagne | 52/712 |
| 5,685,117 | A * | 11/1997 | Nicholson | 52/520 |
| 5,784,848 | A * | 7/1998 | Toscano | 52/519 |
| 5,956,913 | A * | 9/1999 | Nicholson | 52/520 |
| 6,023,889 | A * | 2/2000 | Husting et al. | 52/35 |
| 6,470,642 | B1 * | 10/2002 | Eads | 52/518 |
| 6,487,821 | B1 | 12/2002 | Thomsen et al. | |
| 6,662,509 | B2 * | 12/2003 | Sharp et al. | 52/199 |
| 6,955,012 | B2 * | 10/2005 | Suzuki | 52/198 |
| 7,093,394 | B1 * | 8/2006 | McNamara et al. | 52/35 |
| 7,216,466 | B2 * | 5/2007 | Nystrom | 52/712 |
| 7,441,382 | B2 * | 10/2008 | Beck et al. | 52/543 |
| 2002/0043040 | A1 * | 4/2002 | Cherry et al. | 52/702 |
| 2002/0178671 | A1 * | 12/2002 | Gembala | 52/302.6 |
| 2004/0144040 | A1 * | 7/2004 | Fulford et al. | 52/57 |
| 2005/0086873 | A1 * | 4/2005 | Mares | 52/58 |
| 2005/0204674 | A1 * | 9/2005 | Marshall | 52/544 |
| 2006/0096233 | A1 * | 5/2006 | Nystrom | 52/712 |
| 2006/0096234 | A1 * | 5/2006 | Miller, Jr. | 52/712 |

OTHER PUBLICATIONS

How to Install a Metal Roof, copyright eHow.com 1999-2007, http://www.eHow.com/how_2058233_install-metal-roofing.html, pp. 1-3, Sep. 5, 2007.

Roofing Terms, Dale Tadlock Roofing, Inc., http://www.tadlockroofing.com/roofing_terms.asp, pp. 1-2, Sep. 17, 2007.

Standing-Seam Metal Roof Basics, copyright BobyVila.com 2001, http://bobvila.com/HotTo_Library/Standing_Seam_Metal_Roof_Basics-Metal-A1983.html, pp. 1-3. Sept. 17, 2007.

* cited by examiner

CLOSURE RAIL FOR ROOFING AND METHOD USING SAME

BACKGROUND

1. Field of the Invention

The invention relates to a roofing apparatus and method. More specifically, the invention relates to a closure rail for securing panels to a roof and a method of using a closure rail in roofing.

2. Description of the Prior Art

A common metal roof system is one called a standing seam roof which is constructed of many interlocking panels that run vertically from the roof's ridge to the eave. The interlocking seam, or rib, where two panels join together is raised above the roof's flat surface, allowing water to run off without seeping between panels.

Various methods and means have been employed for attaching each panel to the roof and one panel to the next. Fasteners, such as screws, are a common means for attaching each panel to the roof and clips are often used to connect one panel to the next. Typically panels are attached to the roof first and then ridge and hip caps are used with "Z" closures to form a watertight seal against rain and weather.

Some components for a standing seam roof may be shaped and cut at the jobsite and other components, such as the panels, are often shaped by a manufacturer and delivered to the jobsite where they are cut to the specific length for the applicable section of roof, from the eave to the ridge or hip.

The metal used is usually a thin gauge sheet metal and may arrive at the jobsite in a spool to unroll lengths for forming and cutting roof components. A tool known as a brake is a self-contained, portable metalworking tool that may be used at the jobsite for forming and cutting the roof components. Due to expense and weight, the gauge of the metal is usually thin, making the metal easily shaped by the brake into the desired components. Portable mills may also be available on a jobsite to roll form roof panels.

BRIEF SUMMARY

A closure rail for use with panels in roofing may comprise of a cover, expanse, extension, and flange. A closure rail may be secured along a ridge, hip, or eave of a roof, or in combination, to receive and secure panels. The closure rail may be formed from a sheet of metal, folded or creased to create the cover, expanse, extension, and flange. In use, the expanse may at first be secured to the roof, with the cover, extension, and flange still having some mobility. The closure rail may further have a hinge, connecting adjoining sides of the cover and expanse to allow the cover to close down on the expanse with an end of a panel between the cover and expanse. The extension may be attached to the side of the cover opposite that of the expanse and may connect to a flange. The extension may elevate the flange above the height of a rib on a panel to facilitate attachment of a ridge or hip cap or flashing.

Multiple covers may attach to one expanse, thereby allowing one closure rail to secure multiple panels. A notch may be between each cover to allow space for receiving a rib of a panel. The closure rail may be used on roofs of any slope, from completely vertical to completely horizontal.

A closure rail in roofing may allow a user to attach the closure rail, which may be utilized instead of the commonly used "Z" closures, to a roof before securing the panels to the roof. Securing the panels second may reduce the need for cumbersome alignment or measuring while positioning of the panels into place, thereby increasing efficiency and creating other advantages. For example, using a closure rail decreases the need to set items, such as tools, on the panels or walking on panels, which may damage the panels and result in slippage of items or workers from the roof.

DETAILED DESCRIPTION

A closure rail for roofing may generally comprise of a cover, an extension, a flange and an expanse. The cover may connect to the expanse along one side by a hinge, which connects to one side of the expanse. The side of the cover opposite of the hinge may attach to a side of the extension which may attach to a side of the flange. The hinge and connections between the expanse, cover, extension, and flange may be by various means. Preferably, the closure rail is formed from one sheet of material, preferably metal, and the hinge and connections are folds in the sheet of material. A brake may be utilized for forming the closure rail at the jobsite or may be fabricated in a sheet metal shop using a hand brake, power brake, or a custom roll-forming machine.

Figure 1:
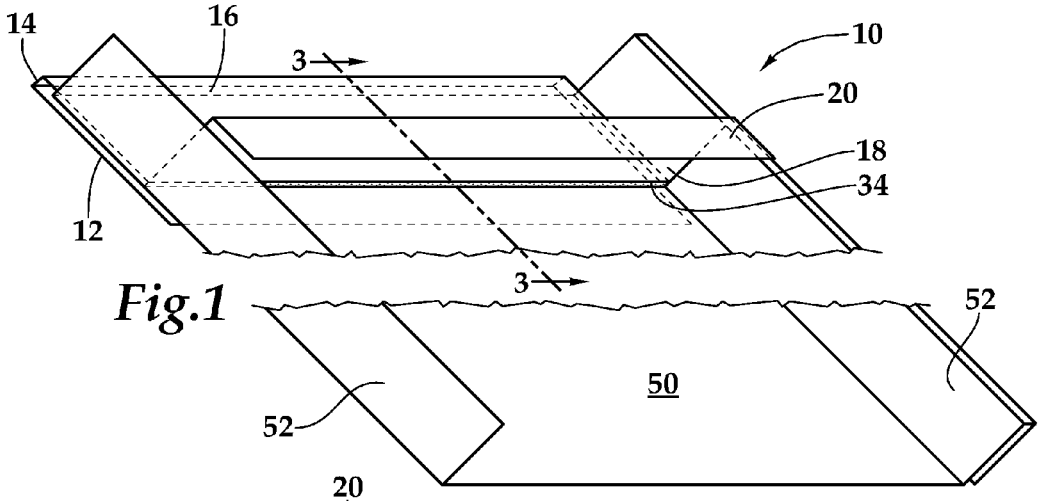
FIG. 1 is a plan view of a closure rail with a panel.
Figure 2:
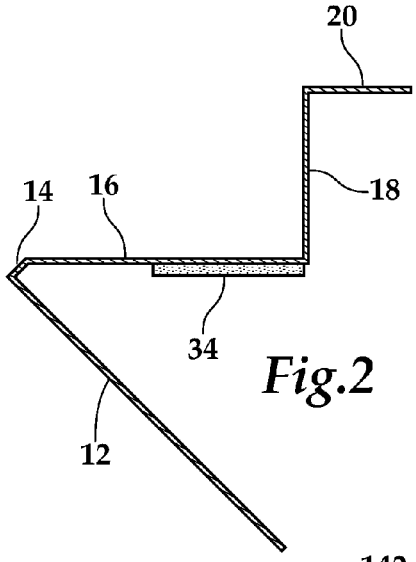
FIG. 2 is a side view of a closure rail.
Figure 3:
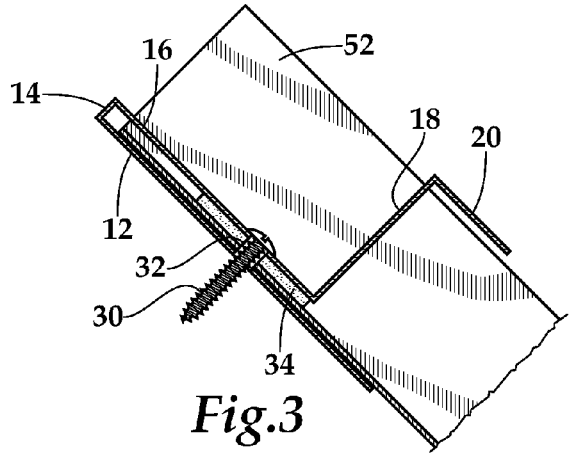
FIG. 3 is a cross-section view of the closure rail and panel along line 3-3 in FIG. 1.

As shown in FIGS. 1-3, one embodiment of a closure rail 10 may receive an end of a panel 50. Expanse 12 may be fixed to the roof along a ridge or hip with hinge 14 parallel to the crown of the ridge or hip. Alternatively, expanse 12 may be fixed near an eave with hinge 14 along the length of the eave at or near the low edge of the roof. As shown in FIG. 2, cover 16 and expanse 12, at rest, may not be on the same plane, creating an open angle at hinge 14 to receive panel 50 and, as shown in FIG. 3, when the end of the panel 50 is positioned between cover 16 and expanse 12, cover 16 may be closed down onto panel 50. Extension 18 may protrude upward from the roof, preferably perpendicularly from the plane of cover 16. Flange 20 may attach to extension 18, preferably perpendicularly to extension 18 and parallel to the plane of cover 16, as shown in FIG. 2. Flange 20 may provide an area for attaching a flashing, such as a ridge or hip cap or flashing, and extension 18 may raise flange 20 above the height of a rib 52 on panel 50, as shown in FIG. 3.

Cover 16, extension 18, and flange 20 may all have lengths corresponding to the width of panel 50 being employed for the roof. Panel 50 widths could range from about 8 to about 30 inches, with standard widths for panels 50 are about 12, 16, and 18 inches. A closure rail could be customized to any width panel 50. Thus, cover 16 and extension 18 may each have a length approximately equal to the width of the panel 50 being employed for the roof, or, preferably, slightly less than the width of the distance between the ribs 52 of a panel 50 to enable cover 16 to close down on the end of the panel without interference from ribs 52.

Expanse 12 preferably has a length equal to or greater than the width of panel 50, and a width extending beyond the width of cover 16, as shown in FIGS. 1-3. Expanse 12 may have a width of between about 2 and 16 inches, preferably between about 2 and about 6 inches, and still more preferably about four inches. Cover 16 may have a width of between about 1 and about 12 inches, preferably between about 2 and about 6 inches, and still more preferably about 2⅞ inches. Extension 18 may have a width of between about ½ and about 4 inches, preferably between about 1 and 3 inches, and still more preferably about 1⅝ inches. Extension 18 may have a width corresponding to the height of rib 52. As shown in FIG. 3, extension 18 may have a width about equal to or greater than the height of rib 52, permitting flange 20 to be positioned above rib 52. Flange 20 may have a width of between about ½ and about 4 inches, preferably between about ¾ and about 2 inches, and still more preferably at about 1 inch.

Hinge 14 may be of an acute angle and may create a space for the positioning of the end of panel 50 between cover 16 and the expanse 12. The end of panel 50 would enter into the space from the side opposite hinge 14 and may abut against hinge 14. Alternatively, the position of the end of panel 50 may be adjusted in the space near hinge 14 to align the panels 50 or account for different panel 50 lengths, thereby leaving some space between hinge 14 and the end of panel 50 as shown in FIG. 3.

The end of panel 50 may be affixed in position between cover 16 and expanse 12 by various means. Fasteners 30 may be utilized to affix panel 50 in position. One or more apertures 32 may be present in cover 16 to allow for the passage of the body, but not the head, of fastener 30 into panel 50. Apertures 32 may be round and may be sized for use with fasteners 30, which may be standard screws, and preferably between about 1/16 inch and about ⅜ inch, more preferably about 3/16 inch, in diameter. Preferably between three and eight apertures 32, more preferably about five, are present in cover 16. Apertures 32 may be generally arranged in a line parallel to the length of hinge 14, part way between the middle and the side opposite hinge 14. Fastener 30 inserted through cover 16, or though aperture 32 in cover 16, may go into or through panel 50 and into or through expanse 12. Preferably, as shown in FIG. 3, the tip of fastener 32 passes through cover 14, panel 50 and expanse 12 and into the roof, thereby affixing panel 50 and closure rail 10 to the roof.

In one embodiment, an adhesive may be on the bottom surface of cover 16 and contacts panel 50 when cover 16 is closed down on panel 50. The adhesive may be of various types, but preferably, as shown in FIGS. 1-3 and 6, is butyl tape 34. Butyl tape 34 may extend the length of cover 16 and may be positioned near the side of extension 18 opposite hinge 14. Preferably, butyl tape 34 is used in conjunction with fasteners 30 and apertures 32 to secure panel 50, as shown in FIG. 3.

Figure 4:
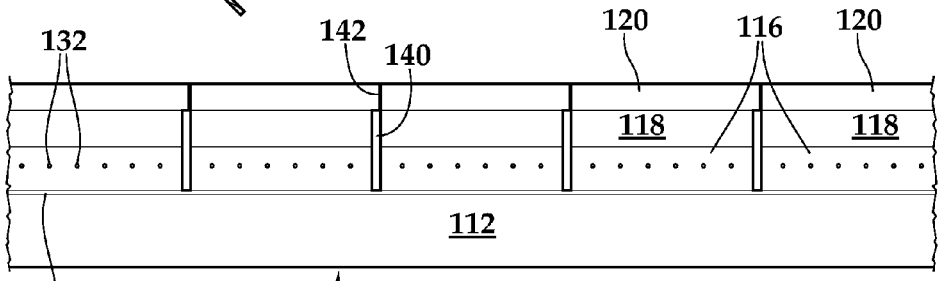
FIG. 4 is a closure rail for multiple panels.

In another embodiment of a closure rail 110, shown in FIG. 4, multiple covers 116, each for attaching a panel 150, are connected to one expanse 112. Covers 112 may be separated by a notch 140. Notch 140 may have a width corresponding to the width of rib 52 on a panel 150 to receive rib 52 when cover 116 is in a closed position. Preferably, notch 140 has a width between about ⅛ and about 3 inches, more preferably between about ⅛ and about ¾ inch, still more preferably about 3/16 inch. Extensions 118 may be of the same length as covers 116 to also fit between ribs 52. Flanges 120 may also be of the same length as covers 116 and extensions 118, or may be longer and extend at least partly over rib 152 received in the corresponding notch 140. Preferably each flange 120 in a closure rail 110 has one side that extends over rib 152, a flap 142, as shown in FIGS. 4 and 5.

Notches may be straight or may have bends. A closure rail 110 for use along the ridge or eave of a roof typically has notches 140 that are generally straight, as shown in FIG. 4. However, a closure rail 210 for use along the hip of a roof, as shown in FIG. 5, typically has notches 240 that are not straight, but rather start at an angle θ, depending on the pitch of the roof, from expanse 212 or hinge 214 and has a first bend 244 at the point where the cover 216 connects with extension 218 and a second bend 246 at the point where extension 218 connects with flange 220. First bend 244 may be at an angle to make notch 240 perpendicular to the axis of hinge 214 and second bend 246 may be at an angle approximately equal to that of the angle θ of notch 240 where cover 216 ends at hinge 214, making notch 240 along side cover 216 parallel to that of notch 240 along the side flange 220. For example, on a roof with a pitch of about 3 to 12, that is a 3 foot height change in a 12 foot length of roof, or about 14 degrees angle from horizon, angle θ of notch 240 may be between about 40 and about 48 degrees, preferably between about 43 and about 45 degrees, still more preferably at about 44.1 degrees. On a roof with a pitch of about 5 to 12, or about a 22.6 degree angle from horizon, angle θ of the notch 240 may be between about 38 and about 46 degrees, preferably between about 41.5 and about 43.5 degrees, still more preferably at about 42.7 degrees.

Figure 5:
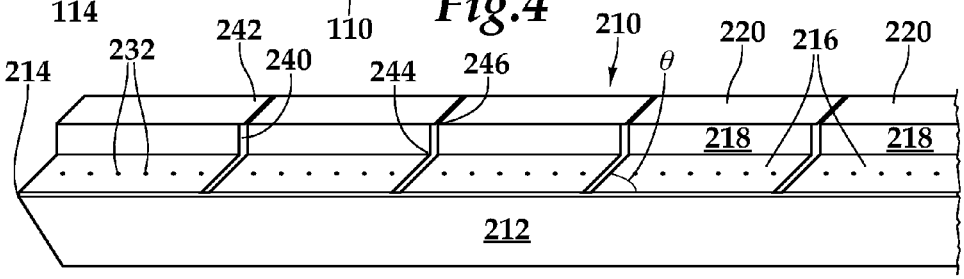
FIG. 5 is a closure rail for multiple panels and designed for placement along the hip of a roof.

As shown in FIGS. 4 and 5, one or more apertures 132, 232 may be on cover 116, 216. Apertures 132, 232 may be round and may be sized for use with fasteners, and preferably between about 1/16 inch and about ⅜ inch, more preferably about 3/16 inch, in diameter. Preferably between three and eight apertures 132, 232, more preferably about five, are present in cover 116, 216. Apertures 132, 232 may be generally arranged in a line parallel to the length of hinge 114, 214.

The length of closure rail 110, 210 may vary according to the dimensions and area of the roof and the materials for making the closure rail. Multiple closure rails may be used on one roof. Closure rail 110 for a ridge or eave and closure rail 210 for a hip may both be used on the same roof. Preferably, the length of closure rail 110, 210 is between about 8 and about 16 feet, more preferably about 12 feet.

Figure 6:
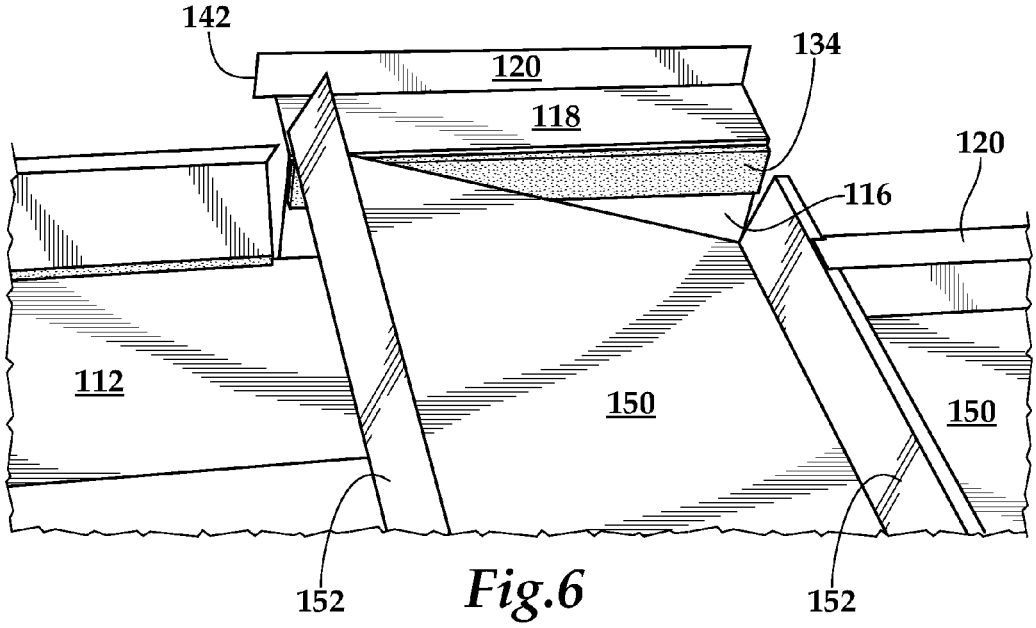
FIG. 6 is a plan view of a closure rail during the installation of a panel.

FIG. 6 shows panel 150 being positioned into place with closure rail 110. Closure rail 110 may be first secured on the roof, preferably by an adhesive or fastener used on expanse 112, and then each panel 150 may be received by closure rail 110 and positioned. The end of panel 150 may slip into the space created by the angle of hinge 140, between cover 116 and expanse 112, and cover 116 may then be closed down onto panel 150. Butyl tape 134 may hold panel 150 in position and fasteners and apertures in cover 116 may secure panel 150 to the roof. Additionally, a sealant, preferably tube caulk, may be used along the edges of the lower edge and sides of extension 118 where it contacts panel 150 and ribs 152.

Figure 7:
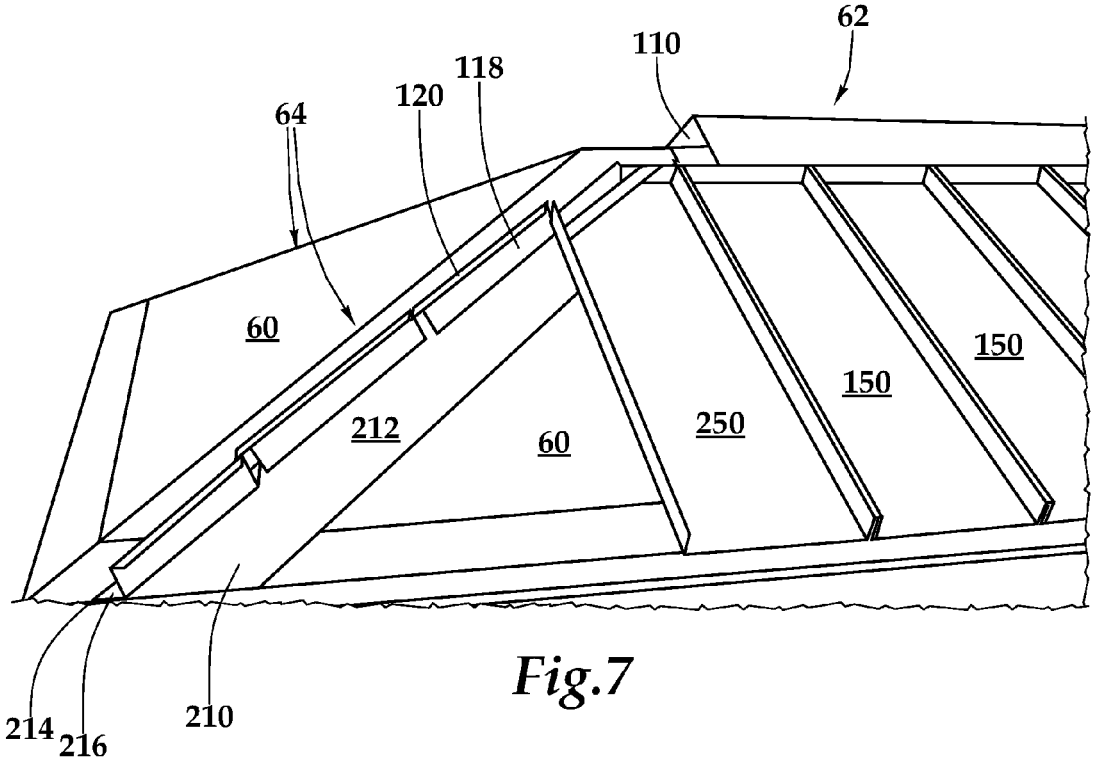
FIG. 7 is a plan view of a roof with a closure rail on a ridge with panels and a closure rail on a hip with panels.

Typically, the most aesthetically pleasing and installer friendly roof system is the internal clip, snap-down, standing seam with panels full length from the eave to ridge. This produces a roof free of exposed fasteners and panel splices. As shown in FIG. 7, closure rail 110 of FIG. 4 may be used along the ridge 62 of roof 60 and closure rail 210 of FIG. 5 may be used along hip 64 of roof 60. In this arrangement, one or both closure rails may be secured to the roof before placement of the panels 150 for ridge 62 and panels 250 for hip 64 on roof 60, which differs from the standard method of roofing.

The standard method of roofing includes first securing the panels and then installing a series of "Z" closures between the ribs of each panel along the hip and ridge. The "Z" closures are then caulked where the "Z" closure meets the ribs and then covered and attached to a cap or flashing. This "panels first" method is the standard method of installation for the industry.

Using a closure rail for roofing allows for an alternative method of installation without the use of "Z" closures. A closure rail with panels provides a high quality barrier to protect a roof and allows for an efficient method of installation. Further, the method reduces many pitfalls present in the "panels first" method.

The "panels first" method when the panels are installed, creates what is similar to a solid row of metal sliding boards. Even at the minimum slope allowed for this roof system, which is a 3 in 12 pitch, anything set on the panels will slide off the roof. While it is possible to walk on the panels at this pitch, it is difficult to kneel or sit down and hold the position on the roof. Another problem that can occur with "panels first" is damage to the paint finish on the panels from work shoes and setting tools and materials on the panels. At 4 in 12 and 5 in 12 pitch the same problems remain and the traction is reduced further for walking and standing on the panel is likely result in slipping or falling from the roof.

In addition, safe work practice calls for fall protection to be worn, the use of which is problematic when using a "panels first" method. Fall protection often comprises a harness and a means of attaching to the roof, typically with rope tied to an anchor fixed on the roof. This is a problem when using the "panels first" method because as the hip and ridge panels are installed any anchor points must penetrate finished panels. Certain mechanical devices are available to help position workers and stage material, but dealing with these devices may be extensive in effort and time to get into place for use and to remove when finished. Most of these devices use clamping pressure of some kind on the panel ribs which often causes paint to scratch and dents to form on the panels. Such damage to the panels may decrease the ability for the roof to protect from water and, furthermore, may void a warranty for the roof. Extreme measure must be taken on pitches over 6 in 12 to position workers and materials and independent mobility is typically not even possible.

Further, avoiding the use of "Z" closures ends the need of having to create a means of establishing a true center point on the hips and ridges to align the "Z" closures for a straight and true line. Finding a true center point typically is a complicated task with a "panels first" method. Mason's string, a construction type laser, or a custom spacing device is often used in the alignment of the "Z" closures. However, the mason's string, attached to a long screw or centering, is not accurate when it's windy, requires mobility on the roof panels, and employs a tedious measuring process. The laser also requires roof mobility, a custom mounted bracket to fit each roof, and must be used in an audio mode in the daylight. Also, center spacing devices, such as these, follow the nape of the ridge and magnify rather than smooth out irregularities. Thus, a method of roofing where the panels are not laid first and without "Z" closures may have advantages over the "panels first" method.

Using a closure rail may also aid panel spacing by having the distances set by the notches. Hip miter panels 250, as shown in FIG. 7, may be pre-cut, folded, and staged because the notches are pre-determined and correspond to the panel length and angle. Further, the closure rail in place provides a handy place for the worker to place small items or tools while securing panels.

Possible expansion and contraction of roof panels is typically addressed by defining a roof system as being "fixed ridge" or "fixed eve". The "fixed ridge" system is more popular in moderate to steep roofs where the top of the panel is attached to the substrate and the bottom of the panel is hemmed over a drip edge to allow for movement. The closure rail performs this "fixing" in addition to weather-guarding the ridge when it is secured to the roof, preferably with fasteners.

The "fixed eve" system is used more on low sloped roofs. This system "fixes" the panel by installing screws through the panel and butyl tape into the structure. With the panel screwed at the bottom, the top of the panel must be free to move to account for the expansion and contraction. The closure rail is adaptable to this because the panel top is sandwiched between the upper and lower member of the closure rail and would be riveted or short screwed in a manner that would not penetrate the substrate and would allow full expansion and contraction of the panels at the ridge.

In addition, a closure rail may decrease the occurrence of panels "creeping" out of place on a roof by securing each panel to the roof and, preferably, closing the end of the panel between the expanse and the cover with butyl tape and using fasteners to secure the cover, panel and expanse.

CAD-CAM technology may be used in making a closure rail. Pre-cut slots to form notches may be burned in the flat using CAD-CAM technology before the rail is formed. Further, CAD-CAM technology may be used in the creation of the closure rail. Calculations for the panel width, rib width and height, and any angles and bends in the notches may be pre-determined and entered into a CAD-CAM system in making a closure rail for the slope of the subject area of the roof.

A closure rail for roofing may comprise a cover having a hinge along one side and an extension along an opposite side, the hinge connecting said cover to an expanse, the extension having a flange along its side opposite said cover and the hinge between said cover and said expanse creates may receive an end of a panel. A closure rail may be substantially made of metal and, further, may be made from a sheet of metal, with the cover, hinge, extension, flange, and expanse created by folds or creases in the sheet of metal.

The cover may have at least one aperture, preferably between about 3 to about 8 apertures and may have a top surface and a bottom surface. An adhesive, preferably butyl tape, may be on the bottom surface to hold a panel in place between the cover and the expanse. Adhesive and fasteners are preferably used in conjunction to secure a panel to the closure rail and to the roof.

Multiple covers, separated by notches, may attach to an expanse for use with multiple panels. The notch may receive the rib of a panel and allow for closure of the cover and extension between the ribs of a panel. A closure rail may be used along a hip of a roof and may have notches at an angle with at least one bend.

A roofing system may comprise of a closure rail, a plurality of panels, and a ridge or hip cap to provide a protective barrier for a roof. Panels may engage the closure rail, sandwiched between the cover and expanse and held in place, preferably with fasteners and adhesive.

A method of roofing a structure with a metal roof having metal panels may comprise attaching a closure rail to the structure and then securing a plurality of panels to the closure rail.

While the foregoing written description of the invention enables one of ordinary skill to make and use what is considered presently to be the best mode thereof, those of ordinary skill will understand and appreciate the existence of variations, combinations, and equivalents of the specific exemplary embodiments and methods herein. The invention should therefore not be limited by the above described embodiments and methods, but by all embodiments and methods within the scope and spirit of the invention as claimed.

What is claimed is:

1. A closure rail for securing a panel along at least one of a hip, ridge or eave of a roof, comprising:

a cover having:

a hinge along one side, and an extension along an opposite side, with a first crease between said cover and said extension;

said hinge connecting said cover to an expanse, said expanse configured to be positioned on the roof;

said extension having a flange along its side opposite said cover, with a second crease between said extension and said flange;

wherein said cover is movable at said hinge between an open configuration for receiving an end of the panel and a closed configuration for maintaining the end of the panel between said cover and said expanse, and further wherein, when in said closed configuration:

said cover and said extension are substantially perpendicular;

said cover and said expanse are substantially parallel;

a first distance is defined between said cover and said expanse;

said extension extends upward from said expanse, such that a second distance is defined between said flange and said expanse, wherein said second distance is greater than said first distance; and said closure rail is configured to receive a fastener through said cover and said expanse to hold said panel.

2. A closure rail for roofing as in claim 1, wherein said closure rail is substantially made of metal.

3. A closure rail for roofing as in claim 2, wherein said closure rail is substantially made from a sheet of metal wherein said cover, hinge, extension, flange, and expanse are created by folds in said sheet of metal.

4. A closure rail for roofing as in claim 1, wherein said cover has at least one aperture.

5. A closure rail for roofing as in claim 4, wherein said cover has 3 to 8 apertures.

6. A closure rail for roofing as in claim 1, wherein said cover has a top surface and a bottom surface and said bottom surface has an adhesive.

7. A closure rail for roofing as in claim 6, wherein said adhesive is butyl tape.

8. A closure rail for roofing as in claim 1, wherein one expanse is connected to multiple covers and each of said covers are separated from each other by a notch.

9. A closure rail for roofing as in claim 8, wherein said notch receives a rib of said panel when said end of said panel is positioned between said cover and said expanse.

10. A closure rail for roofing as in claim 8, wherein each of said notches has at least one bend to further separate multiple extensions or multiple flanges, and said closure rail is for the hip of a roof.

11. A roofing system for a structure, comprising:

a closure rail having an expanse configured to be positioned on the structure, at least two covers, wherein a notch separates a first cover and a second cover, and a hinge between said first cover and said expanse and said second cover and said expanse; and a plurality of panels;

wherein an end of a first panel is configured to attach to said closure rail with said end between said expanse and said first cover;

wherein an end of a second panel is configured to attach to said closure rail with said end of said second panel between said expanse and said second cover;

wherein said first cover is movable at said hinge between an open configuration for receiving said first panel and a closed configuration for maintaining said end of said first panel between said expanse and said first cover;

and further wherein, when in said closed configuration, said notch is configured to receive a rib of at least one of said first panel and said second panel, at least one of said first and second covers is transverse to said rib; and said system is configured to receive a fastener through said first cover, said first panel, and said expanse.

12. A method of roofing a structure with a metal roof having metal panels, comprising:

attaching a closure rail having an expanse to said structure, said closure rail further having at least two covers, wherein a notch separates a first cover and a second cover; then positioning an end of a panel between said expanse and said first cover, wherein said end of said panel extends between a first rib and a second rib, and further wherein said notch receives one of said first and second ribs of said panel;

closing said first cover onto said panel; and then securing said panel between said expanse and said first cover of said closure rail.

13. A roofing system according to claim 11, wherein said expanse is planar.

14. A method of roofing a structure according to claim 12, wherein said securing step comprises installing a fastener through said expanse, said panel and said cover.

15. A method of roofing a structure according to claim 12, wherein said closure rail further comprises an extension having at least one edge, said method further comprising:

applying a sealant between said edge and said panel.

16. A closure rail for roofing according to claim 1, wherein, when in said closed configured, said flange is substantially parallel to at least one of said expanse and said cover.

17. A roofing system for a structure according to claim 11 further comprising a cap.

18. A roofing system for a structure according to claim 11, wherein said first cover has an extension having a first height and said rib has a second height, wherein said extension first height is greater than said rib second height to facilitate attachment of a cap.

19. A method of roofing a structure according to claim 12, wherein said expanse is substantially parallel to said structure.

20. A method of roofing a structure according to claim 12, wherein at least one of said two covers is transverse to at least one of said first and second ribs.

* * * * *